US006923682B2

(12) United States Patent
Akama et al.

(10) Patent No.: US 6,923,682 B2
(45) Date of Patent: Aug. 2, 2005

(54) BALANCED TRANSMISSION CABLE CONNECTOR

(75) Inventors: Junichi Akama, Shinagawa (JP); Satoshi Moriyama, Shinagawa (JP); Mitsuru Kobayashi, Shinagawa (JP); Yoshinori Sata, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/832,349

(22) Filed: Apr. 27, 2004

(65) Prior Publication Data

US 2005/0054226 A1 Mar. 10, 2005

(30) Foreign Application Priority Data

Sep. 10, 2003 (JP) ..... 2003-318517

(51) Int. Cl.[7] ..... H01R 9/03
(52) U.S. Cl. ..... 439/610; 439/98
(58) Field of Search ..... 439/610, 98, 497, 439/579, 608

(56) References Cited

U.S. PATENT DOCUMENTS 6,482,028 B2 * 11/2002 Kumamoto et al. ..... 439/498
6,764,342 B2 * 7/2004 Murayama et al. ..... 439/608
6,786,763 B2 * 9/2004 Wu ..... 439/497

FOREIGN PATENT DOCUMENTS

JP 2003-059593 2/2003

* cited by examiner

*Primary Examiner*—Tho D. Ta
(74) *Attorney, Agent, or Firm*—Staas & Halsey LLP

(57) ABSTRACT

A balanced transmission cable connector with improved high speed signal transmission characteristics is realized by directly connecting a balanced transmission cable to a plug structure. The plug structure includes a block unit, a ground contact, and adjacent pairs of a first signal contact and a second signal contact. The ground contact and the adjacent pairs of the first signal contact and the second signal contact are aligned in an alignment direction with respect to one another and are held by the block unit. The ground contact is disposed in between the adjacent pairs of the first signal contact and the second signal contact. The first signal contact includes a first signal wire connecting portion to which a first signal wire of the balanced transmission cable is connected, and the second signal contact includes a second signal wire connecting portion to which a second signal wire of the balanced transmission cable is connected. The ground contact includes a drain wire connecting portion to which a ground wire of the balanced transmission cable is connected.

24 Claims, 13 Drawing Sheets

BALANCED TRANSMISSION CABLE CONNECTOR

BACKGROUND OF THE INVENTION

1. Field of the Invention

The present invention relates generally to a balanced transmission cable connector, and particularly to a balanced transmission cable connector that is used for high speed signal transmission.

2. Description of the Related Art

As data transmission schemes for transmitting data, a normal transmission scheme using one wire for each set of data may be used, or a balanced transmission scheme using a pair of wires for each set of data may be used to simultaneously transmit a (+) signal that is to be transmitted and a (−) signal in an opposite direction of the (+) signal but of the same size. In the balanced transmission scheme, influence from noise may be reduced compared to the normal transmission scheme. Thus, the balanced transmission scheme is becoming increasingly popular. A balanced transmission cable connector used in the balanced transmission scheme includes a balanced transmission cable, a plug that is implemented at the end of the balanced transmission cable, and a shield cover that covers the plug portion. For example, the balanced transmission cable connector may be used for establishing connection between a computer and a server.

FIGS. 1 and 2 are diagrams illustrating a balanced transmission cable connector 10 according to the related art. It is noted that directions X1-X2, Y1-Y2, and Z1-Z2 correspond to width directions, length directions, and height directions, respectively.

FIG. 3 shows a configuration of a balanced transmission cable 20. As is shown in this drawing, the balanced transmission cable 20 has an outer coating 27 and a shield mesh wire 28 that forms a dual coated tube structure inside of which plural wire lines 21 are implemented. Each wire line 21 includes a pair of first and second coated signal wires 22-1 and 22-2, and a drain wire 25 that are accommodated inside a shield tube.

As is shown in FIG. 6, the first and second coated signal wires 22-1 and 22-2, and the drain wire 25 extend from the end of the shield tube, and the ends of the first and second coated signal wires 22-1 and 22-2 are processed so that first and second signal wires 23-1 and 23-2 are exposed. It is noted that the first and second coated signal wires 22-1 and 22-2, and the exposed first and second signal wires 23-1 and 23-2 make up a wire pair.

Referring back to FIGS. 1 and 2, the balanced transmission cable connector 10 includes a relay substrate 12 that is fixed at the Y1 side of a plug structure 11. The plural wire lines 21 extend from the end of the balanced transmission cable 20, and the first and second signal wires 23-1 and 23-2, and the drain wires 25 extend further from the shield tube of the respective wire lines 21 to be connected to Y1 side terminals of the relay substrate 12 through soldering. Shield covers 31 and 32 cover the plug structure 11, the relay substrate 12, and an end portion of the balanced transmission cable 20. In this balanced transmission cable connector 10, the plug structure 11, the relay structure 12, and the end portion of the balanced transmission cable 20 realize data transmission paths.

However, in the balanced transmission cable connector 10, problems exist with regard to shielding adjacent transmission paths from one another at the relay substrate 12. The relay substrate 12 includes wiring patterns that extend in the Y1-Y2 directions and are aligned in the X1-X2 directions at the top and bottom surfaces of the relay substrate 12. In such a configuration, it is difficult to adequately shield adjacent signal pairs from each other at the relay substrate 12 to obtain the same shielding effect as that realized at the plug structure 11.

In recent years and continuing, the transmission speed of signals being handled by computers and servers is accelerating, and in turn, influences on the transmission characteristics due to poor shielding at the relay substrate 12 are becoming a problem.

SUMMARY OF THE INVENTION

The present invention has been conceived in response to one or more problems of the related art, and its object is to provide a balanced transmission cable connector with improved transmission characteristics for high speed signal transmission.

Specifically, the present invention provides a balanced transmission cable connector, including:

a balanced transmission cable that includes a drain wire and at least one wire pair of a first coated signal wire and a second coated signal wire, the first and second coated signal wires including respective first and second coatings and respective first and second signal wires extending from the respective first and second coatings; and a plug structure including a block unit, a ground contact, and first and second adjacent pairs of a first signal contact and a second signal contact, wherein the ground contact and the first and second pairs of the first signal contact and the second signal contact are aligned in an alignment direction with respect to one another and held by the block unit, and wherein the ground contact is disposed between the first and second adjacent pairs of the first signal contact and the second signal contact; wherein at least one of the first signal contacts includes a first signal wire connecting portion to which the first signal wire is connected, and at least one of the second signal contacts includes a second signal wire connecting portion to which the second signal wire is connected; and wherein the ground contact includes a drain wire connecting portion to which the ground wire is connected.

In an aspect of the present invention, first and second signal wires and a drain wire of a balanced transmission cable are connected to first and second signal contacts and a ground contact of a plug structure, and the ground contact is arranged to be longer than the first and second signal contacts. Accordingly, a shielding effect may be improved between a transmission path for transmitting a balanced signal and an adjacent transmission path for transmitting another balanced signal, and transmission characteristics may be improved so that high speed signal transmission may be realized.

DESCRIPTION OF THE PREFERRED EMBODIMENTS

In the following, preferred embodiments of the present invention are described with reference to the accompanying drawings.

Figure 4:
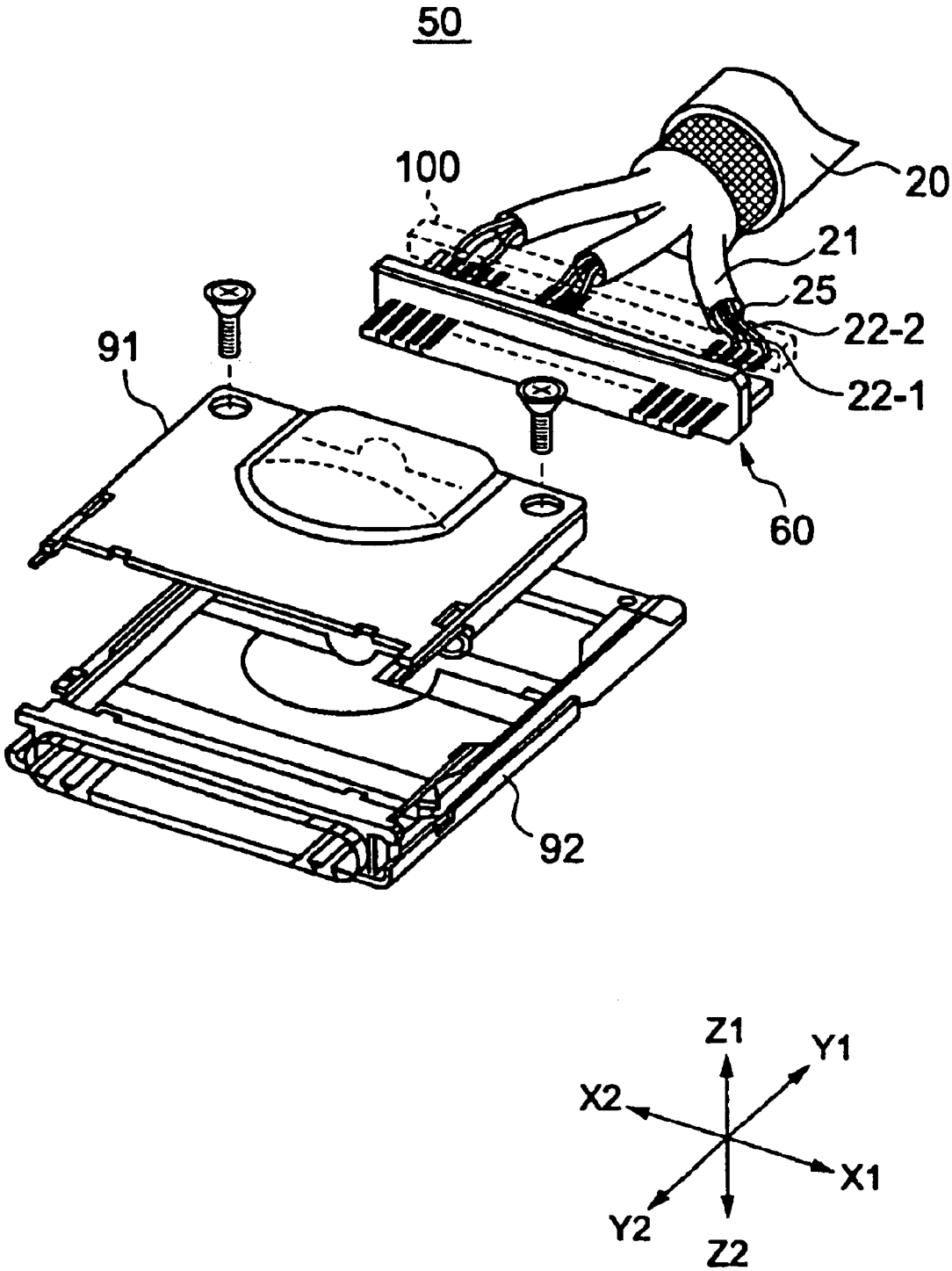
FIG. 4 shows a perspective view of a balanced transmission cable connector according to a first embodiment of the present invention.
Figure 5:
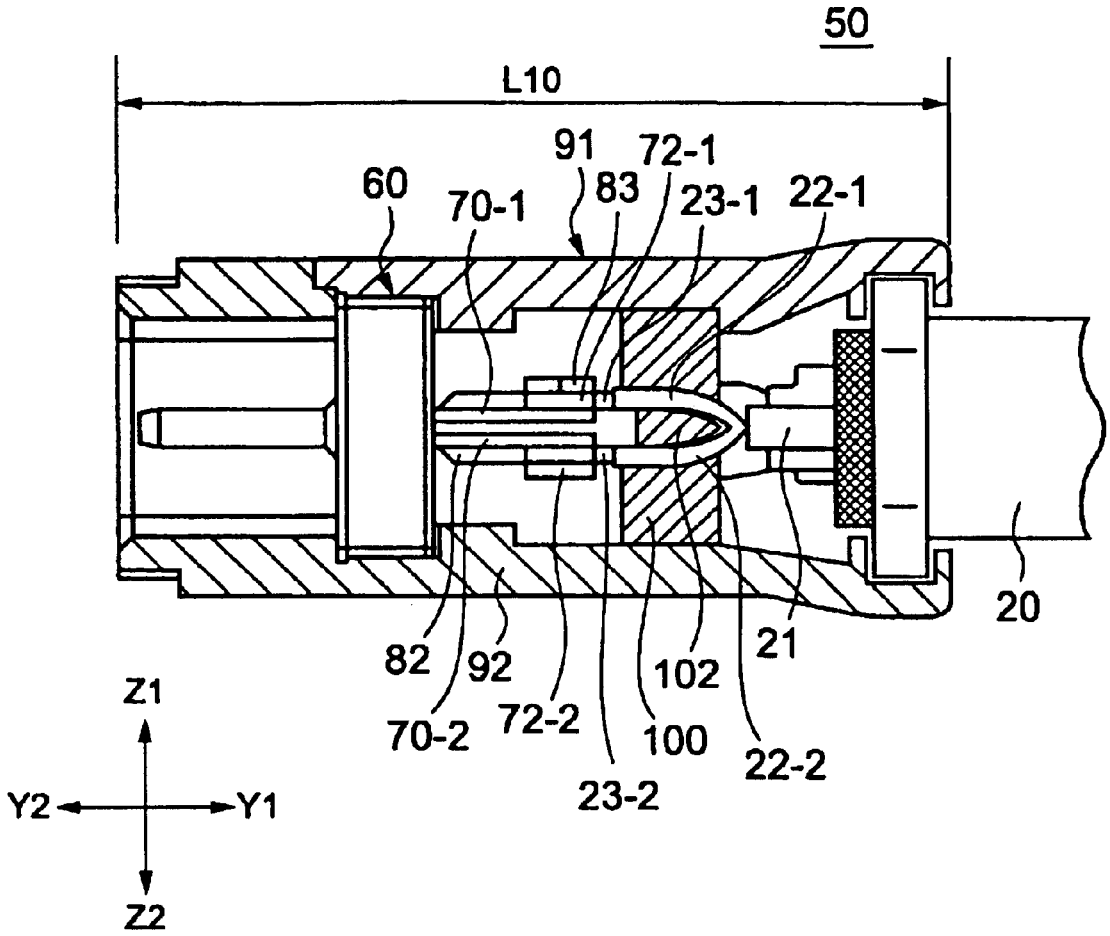
FIG. 5 shows a cross-sectional view of the balanced transmission cable connector of FIG. 4.

FIGS. 4 and 5 illustrate a balanced transmission cable connector 50 according to a first embodiment of the present invention. It is noted that directions X1-X2, Y1-Y2, and Z1-Z2 respectively correspond to width directions, length directions, and height directions of the balanced transmission cable connector 50. Also, the direction Y1 corresponds to a front side and the direction Y2 corresponds to a back side.

Figure 1:
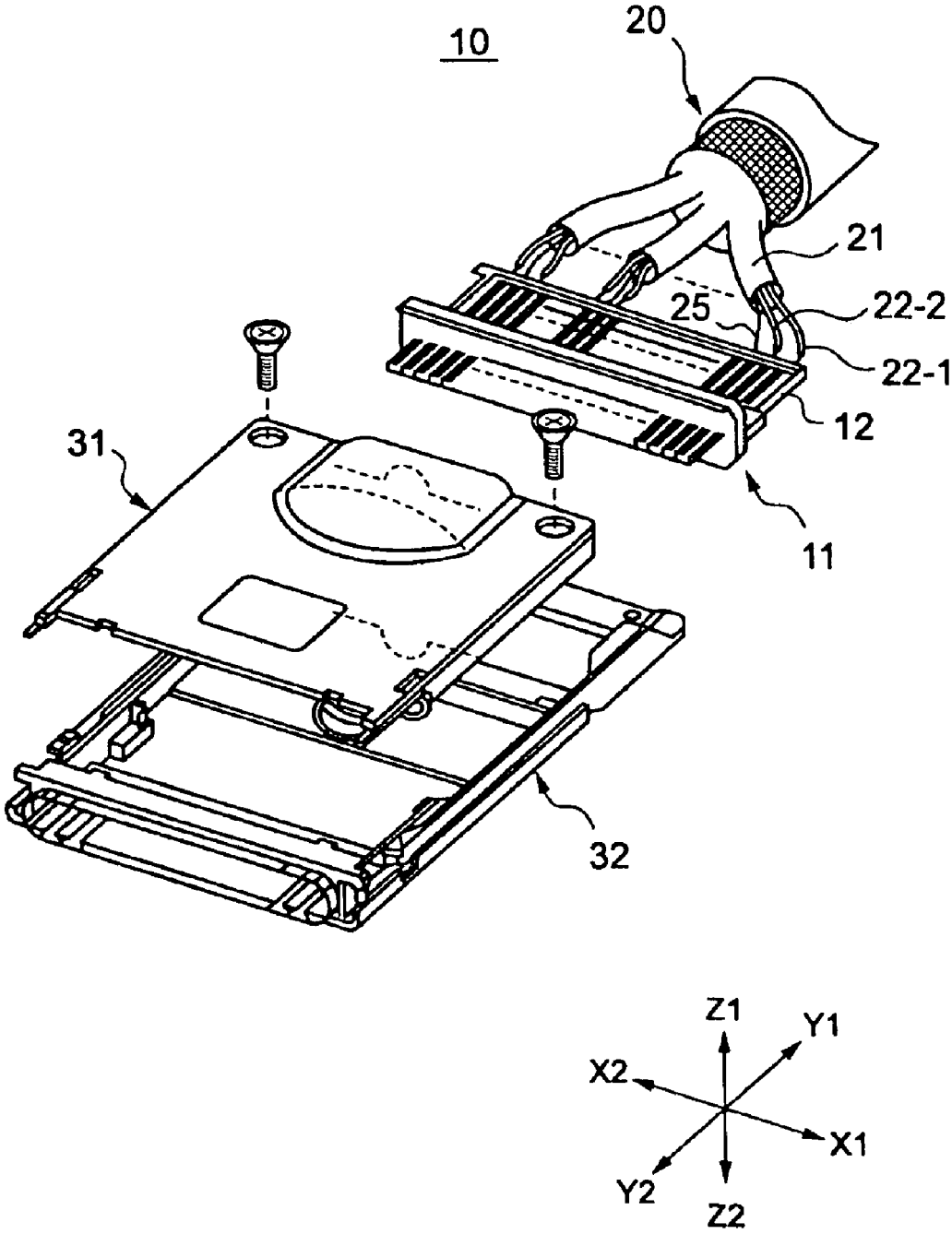
FIG.1 PRIOR ART
FIG. 1 shows a perspective view of a balanced transmission cable connector in a deconstructed state according to the related art.
Figure 2:
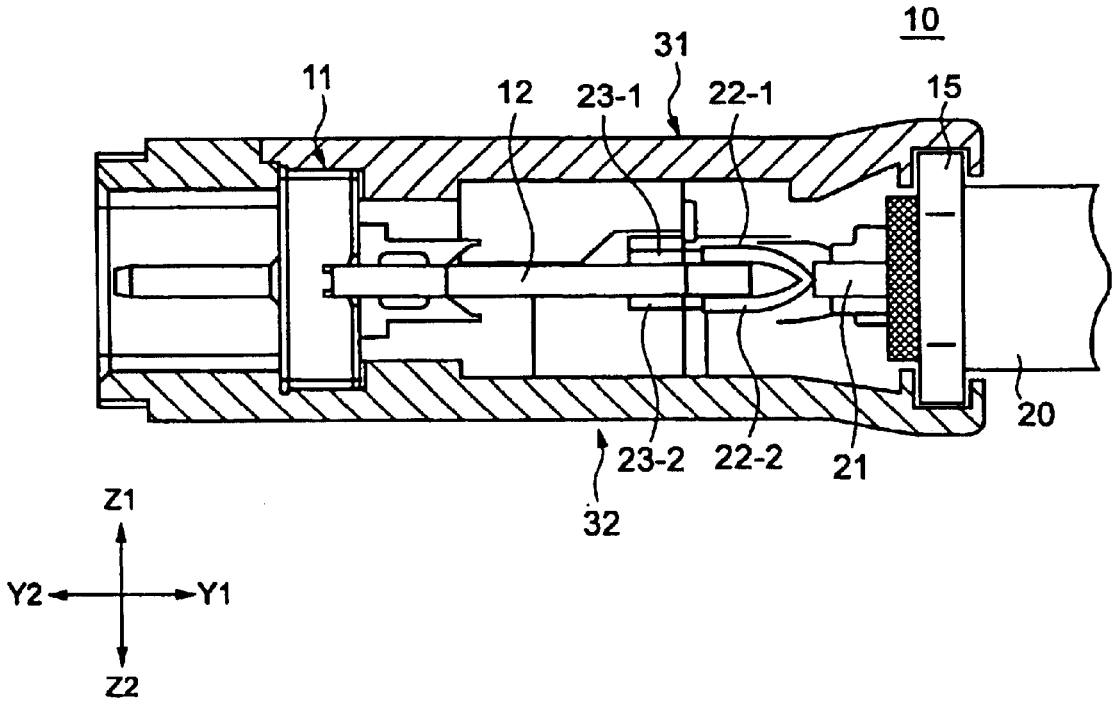
FIG.2 PRIOR ART
FIG. 2 shows a cross-sectional view of the balanced transmission cable connector of FIG. 1.
Figure 3:
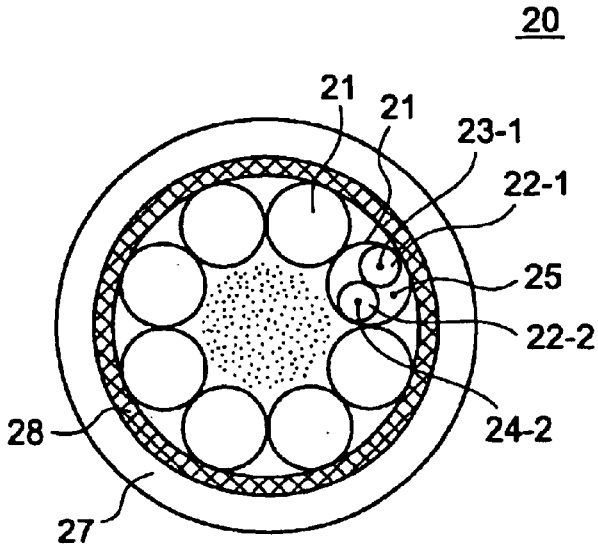
FIG. 3 shows a cross-sectional view of a balanced transmission cable.

The balanced transmission cable connector 50 differs from the balanced transmission cable connector 10 shown in FIGS. 1 and 2 in that it does not include the relay substrate 12. The extended ends of the balanced transmission cable 20 are directly connected to a plug structure 60 through soldering, and shield covers 91 and 92 cover the plug structure 60, a wire arranging member 100, and the end portion of the balanced transmission cable 20. Additionally, signal pairs and grounds are alternatingly implemented in the X1-X2 directions so that adjacent signal pairs may be shielded from each other.

Figure 6:
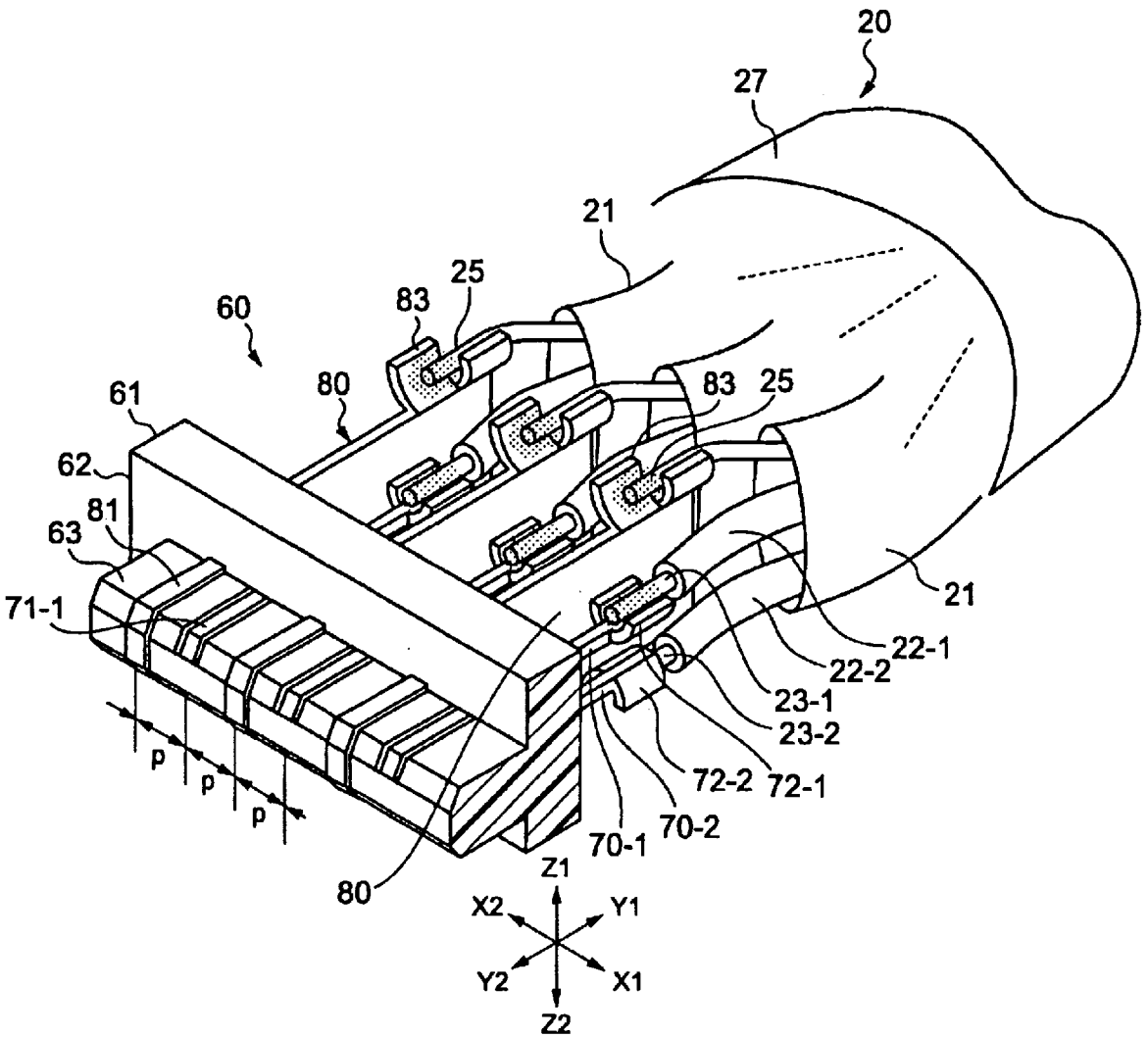
FIG. 6 shows an enlarged view of a connecting portion of a balanced transmission cable and a plug structure in the balanced transmission cable connector of FIG. 4.

FIG. 6 shows an enlarged view of the portion at which the extending ends of the balanced transmission cable 20 are directly connected to the plug structure 60. It is noted that in this drawing, the wire arranging member 100 is not shown for the sake of convenience. In the illustrated embodiment, the balanced transmission cable 20 used in the balanced transmission cable connector 50 is similar to that used in the balanced transmission cable connector 20 shown in FIGS. 1 and 2, although it will be appreciated that other suitable types of balanced transmission cables may be employed.

In the following, the plug structure 60 is described with reference to FIGS. 6~8. The plug structure 60 includes a block unit 61 corresponding to a synthetic resin molded article provided with electrical isolation. Pairs of first and second signal contacts 70-1 and 70-2, and sheet-shaped ground contacts 80 are press fit into the block unit 61 from the Y1 side to be alternatingly arranged in the X1-X2 directions at predetermined pitches p. In this configuration, the pairs of the first and second signal contacts 70-1 and 70-2 that are adjacent to each other with respect to the X1-X2 directions are shielded by the ground contact 80. Also, the first and second signal contacts 70-1 and 70-2, and the ground contacts 80 are electrically isolated by the block unit 61.

The block unit 61 includes a base portion 62 extending lengthwise in the X1-X2 directions and a mound-shaped protruding portion 63 also extending lengthwise in the X1-X2 directions and protruding in the Y2 direction substantially from the Z1-Z2 center of the base portion 62.

Figure 7:
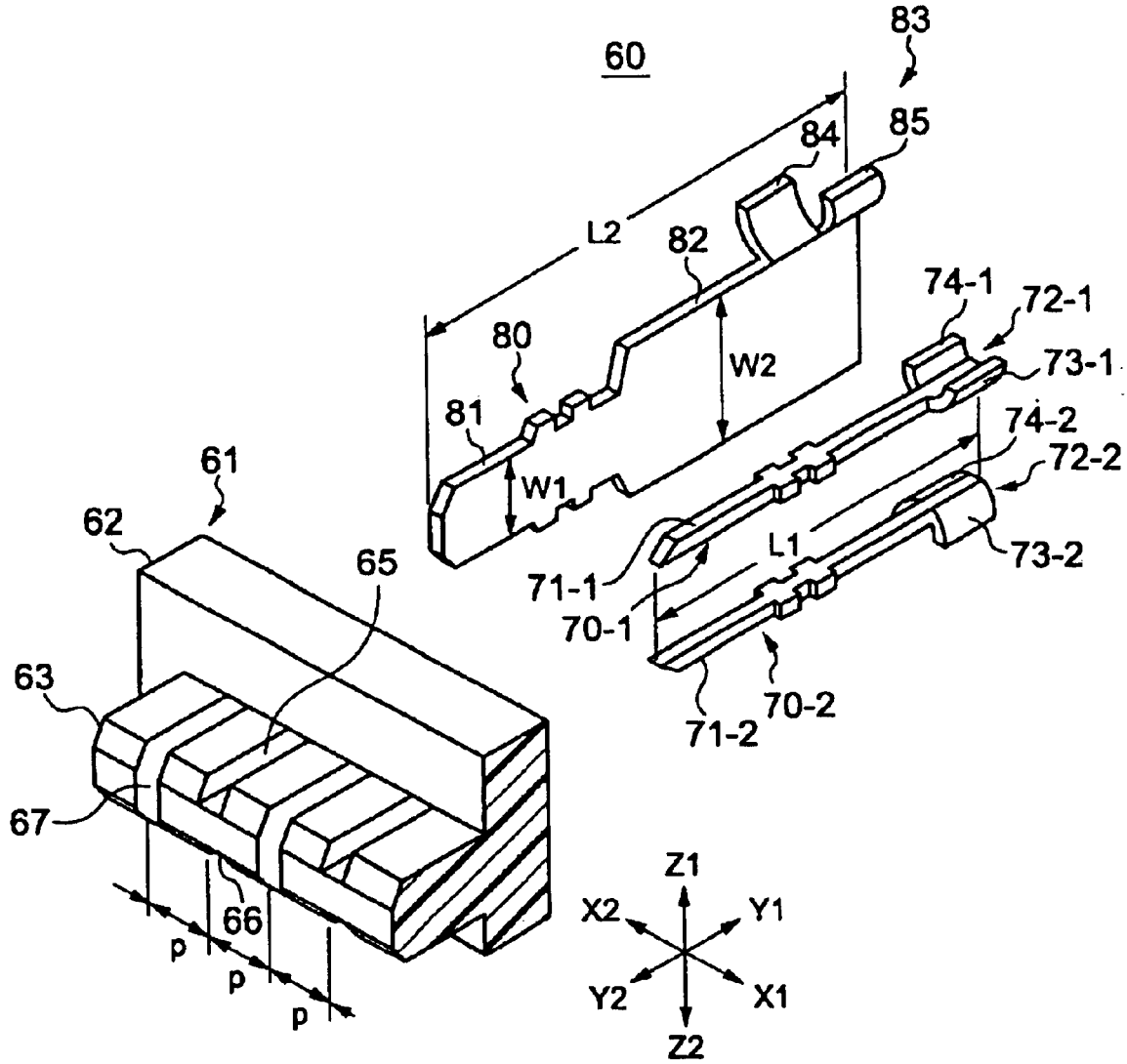
FIG. 7 shows a perspective view of the plug structure of FIG. 4 in a partially deconstructed state.
Figure 8:
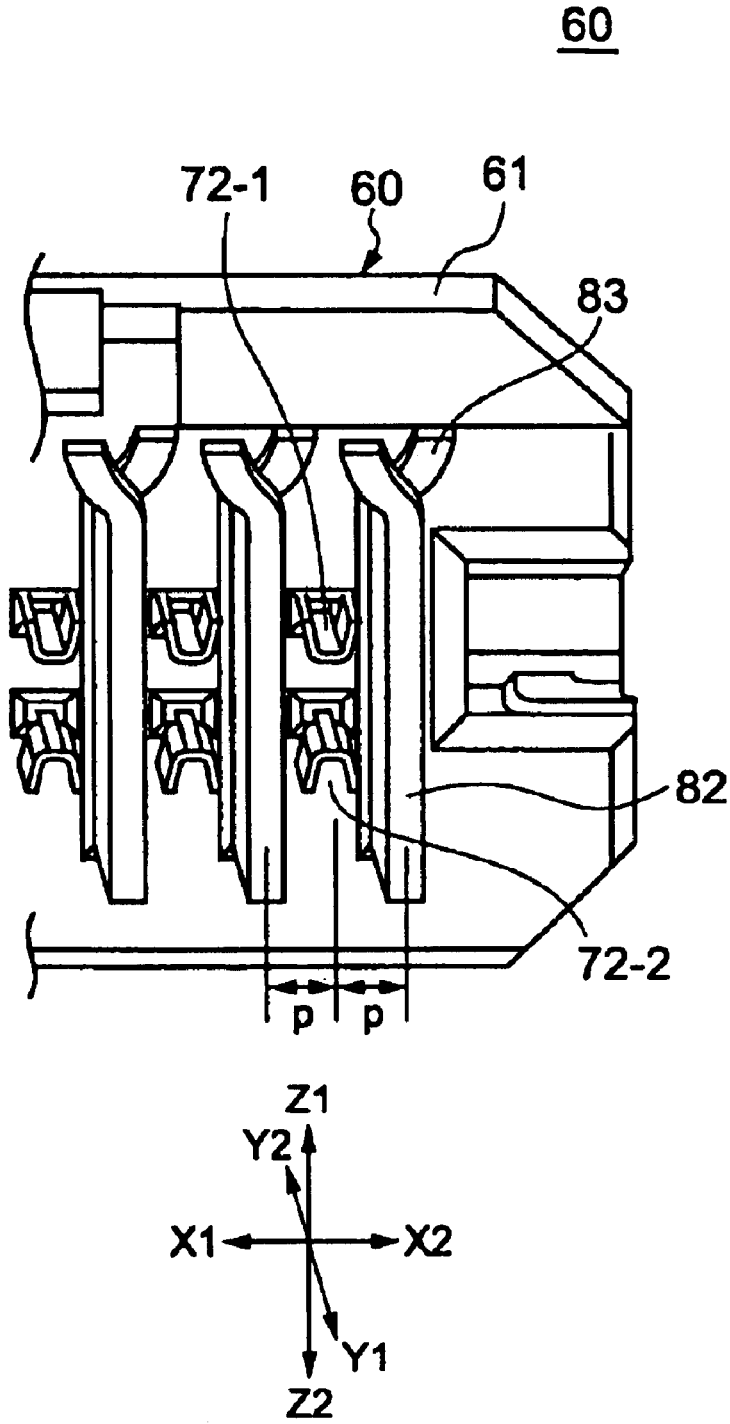
FIG. 8 shows a perspective view of the plug structure of FIG. 4 viewed from its back side.

FIG. 7 shows the plug structure 60 in a partially deconstructed state to facilitate understanding of its configuration. As is shown in this drawing, the block unit 61 includes trenches 65 and 66 into which the first and second signal contacts 70-1 and 70-2 may be press fit, and slits 67 into which the ground contacts 80 may be press fit, or otherwise secured.

The first signal contact 70-1 includes a rod-shaped contact main body 71-1 at the Y2 side, and a U-shaped signal wire connecting portion 72-1 at the end of the Y1 side. The signal wire connecting portion 72-1 includes lug portions 73-1 and 74-1 that extend in the X1-X2 directions and are bent in the Z1 direction to configure the signal wire connecting portion 72-1 into a U-shape. The signal wire connecting portion 72-1 is open at the Z1 side, and is thereby capable of holding in place a signal wire that deviates in the X1-X2 directions.

The second signal contact 70-2 has an upside down configuration of the first signal contact 70-1. That is, the second signal contact 70-2 includes a rod-shaped contact main body 71-2 at the Y2 side, and an upside down U shape wire connecting portion 72-2 at the Y1 side. The signal wire connecting portion 72-2 includes lug portions 73-2 and 74-2 that extend in the X1-X2 directions and are bent in the Z2 direction to configure the signal wire connecting portion 72-1 into an upside down U-shape. The signal wire connecting portion 72-2 is open at the Z2 side, and is thereby capable of holding in place a signal wire that deviates in the X1-X2 directions.

The ground contact 80 is formed substantially into a sheet shape, and includes a Y2 side ground contact portion 81, a Y1 side ground contact portion 82, and a U-shaped drain wire connecting portion 83. The Y1 side ground contact portion 82 has a width W2 that is greater than a width W1 of the Y2 side ground contact portion 81. The drain wire connecting portion 83 is formed at the Y1 side end portion of the Y1 side ground contact portion 82, and includes lug portions 84 and 85 that extend in the X2 and X1 directions, respectively, from the Z1 side edge of the Y1 side ground contact portion 82, and curve toward each other to form a U-shaped structure when viewed from the Y1 side.

Given that the lengths of the first and second signal contacts 70-1 and 70-2 are equal to L1, and the length of the ground contact 80 is equal to L2, a relation L2>L1 is established.

The first and second signal contacts 70-1 and 70-2 are press fit or otherwise secured into trenches 65 and 66, respectively, and the Y2 side ground contact portion 81 of the ground contact 80 is press fit or other wise secured into the slit 67.

In the following, the positioning of the first and second signal contacts 70-1 and 70-2, and the ground contact 80 is described.

Figure 9A:
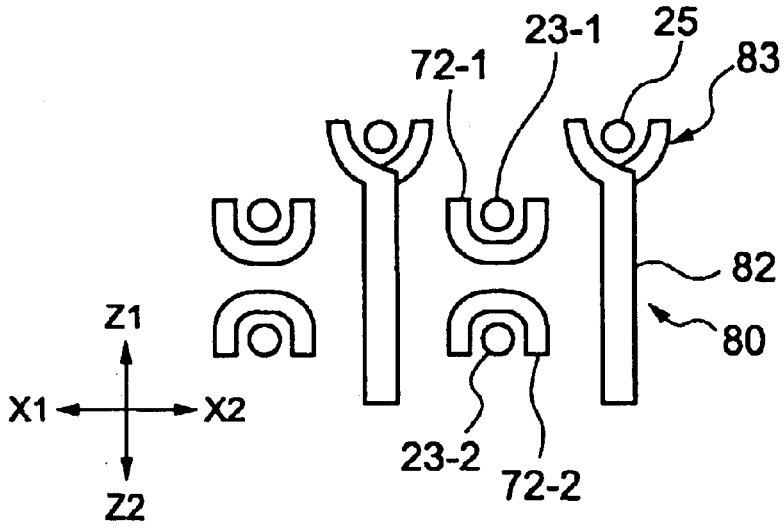
FIGS. 9A and 9B are diagrams showing the positioning of signal contacts, a ground contact, signal wires, and a drain wire in the balanced transmission cable connector of FIG. 4.
Figure 9B:
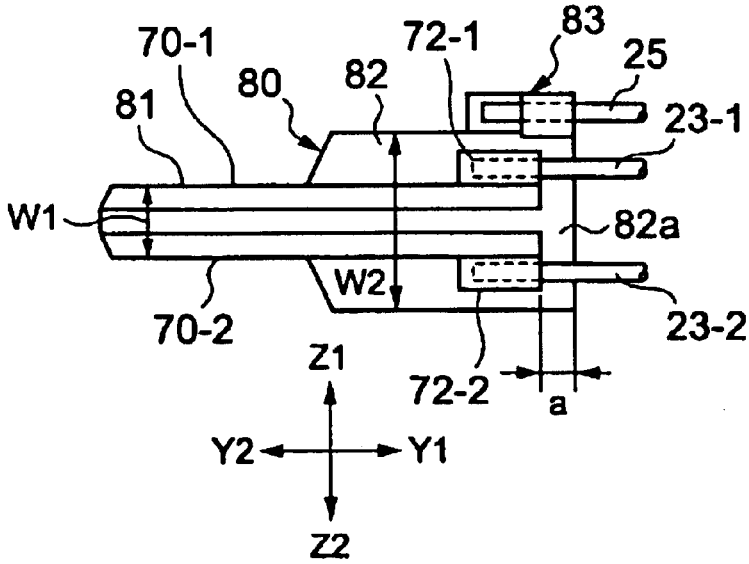

FIG. 9A illustrates a positioning of the first and second signal contacts 70-1 and 70-2, and the ground contact 80 viewed from the Y1 side, and FIG. 9B illustrates a positioning of the first and second signal contacts 70-1 and 70-2, and the ground contact 80 viewed from the X1 side.

As is shown in FIG. 9B, with respect to the Y1-Y2 directions, the ends of the first and second signal contacts 70-1 and 70-2, and the ground contact 80 are at the same positions on the Y2 side. On the Y1 side, the ground contact 80 extends in the Y1 direction beyond the Y1 ends of the wire connecting portions 72-1 and 72-2 of the signal contacts 70-1 and 70-2. A portion 82*a* corresponds to the portion of the ground contact 80 extending in the Y1 direction beyond the Y1 ends of the wire connecting portions 72-1 and 72-2, the portion 82*a* having length 'a'. Upon viewing the positioning of the contacts from the X1 side, the first and second signal contacts 70-1 and 70-2 respectively extend along the Z1 and Z2 side edges of the Y2 side ground contact portion 81. Thus, when viewing the structure from the Y2 side, the first and second signal contacts 70-1 and 70-2 may be hidden within a projected region of the ground contact 80. As a result, a first pair of a first and second signal contact 70-1 and 70-2 adjacent to a second pair of a first and second signal contact 70-1 and 70-2 may be effectively shielded by the ground contact 80 with respect to the X1-X2 directions.

The drain wire connecting portion 83 is positioned toward the Y1 direction side from the positions of the signal wire connecting portions 72-1 and 72-2 as is shown in FIG. 9B, and the drain wire connecting portion 83 is positioned toward the Z1 direction side from the positions of the signal wire connecting portions 72-1 and 72-2 as is shown in FIG. 9A and FIG. 9B.

In the following, the wire arrangement of the wires of the balanced transmission cable 20 is described with reference to FIGS. 10A~10C.

Figure 10A:
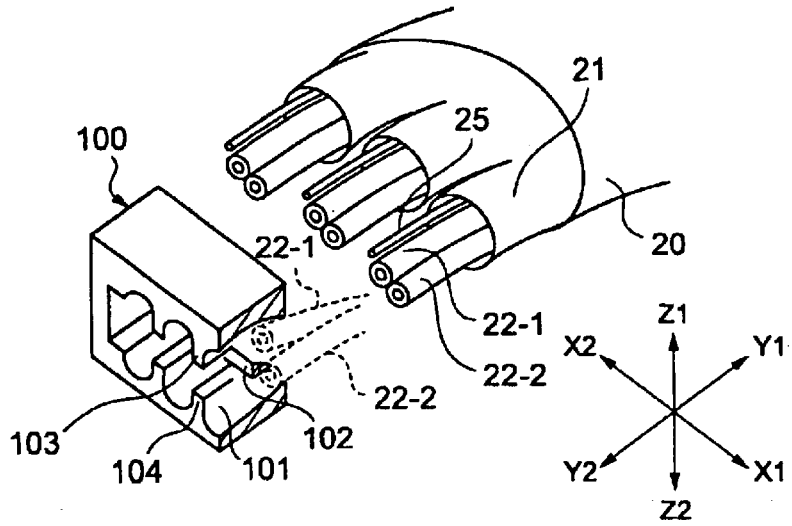
FIGS. 10A~10C are diagrams illustrating an arrangement the signal wires in the balanced transmission cable connector of FIG. 4.
Figure 10B:
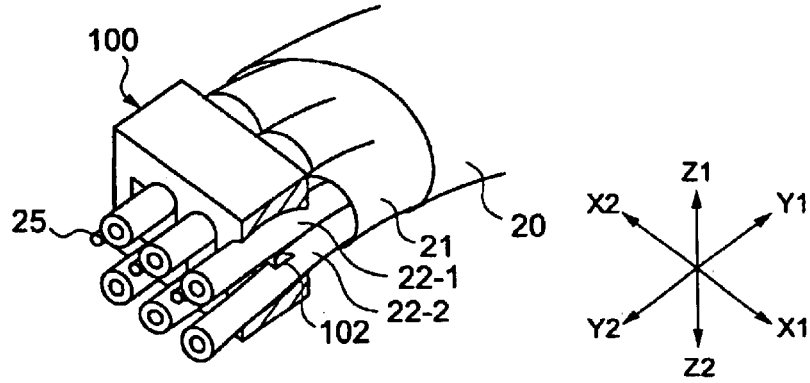
Figure 10C:
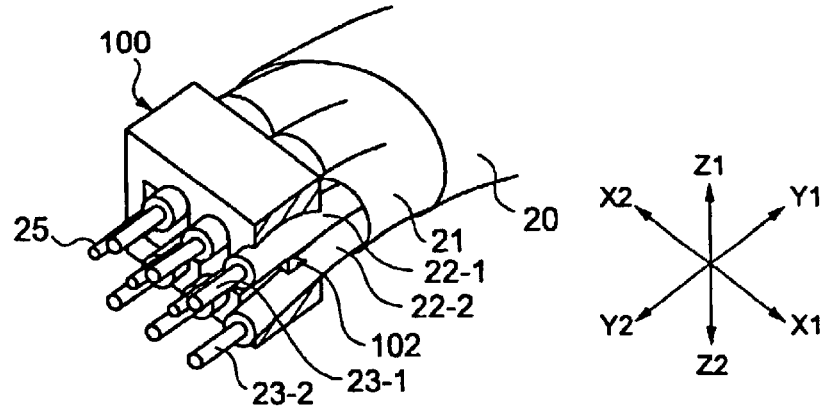

In FIGS. 10A~10C, the wires of the balanced transmission cable 20 are arranged by a wire arranging member 100. In the following, the first and second coated signal wires 22-1 and 22-2 are referred to as a wire pair.

As is shown in FIG. 10A, the wire arranging member 100 has a rectangular configuration, and includes an inter wire pair arranging portion 101 that separates adjacent wire pairs by a partition, and a wedge-shaped wire pair internal arranging portion 102 that partitions the first coated signal wire 22-1 and the second coated signal wire 22-2 of a wire pair from each other. The inter wire pair arranging portion 101 includes partition wall portions 103 and 104 that separate adjacent wire pairs. The wire pair internal arranging portion 102 is implemented within the inter wire pair arranging portion 101, and sections the space within the inter wire pair arranging portion 101 in the X1-X2 directions. The wire pair internal arranging portion 102 has a wedge structure with a pointed end positioned toward the Y1 direction. It is noted that the inter wire pair arranging portion 101 and the wire pair internal arranging portion 102 may be adjusted according to the positioning of the wire connecting portions 72-1 and 72-2.

As is shown in FIG. 10A, when the first and second coated signal wires 22-1 and 22-2, and the drain wire 25 that extend from the end of the shield tube of the wire line 21 are inserted into the inter wire pair arranging portion 101 of the wire arranging member 100 from the Y1 side, the first and second coated signal wires 22-1 and 22-2 are partitioned in the Z1-Z2 directions by the wire pair internal arranging portion 102 as is indicated by the dotted lines.

When the wire line 21 reaches a predetermined insertion position, the first and second coated signal wires 22-1 and 22-2, and the drain wire 25 protrude from the wire arranging member 100 to the Y2 side as is shown in FIG. 10B. In this case, the first and second coated signal wires 22-1 and 22-2 of a wire pair and the first and second coated signal wires 22-1 and 22-2 of its adjacent wire pair are partitioned by the inter wire pair arranging portion 101, and the first and second coated signal wires 22-1 and 22-2 of each wire pair are partitioned by the wire pair internal arranging portion 102. In other words, wire arrangement between adjacent pairs of wires as well as wire arrangement between the wires of each wire pair may be realized. After the insertion, the coating is removed from the tips of the first and second coated signal wires 22-1 and 22-2 to expose the signal wires 23-1 and 23-2. In this way, the signal wires 23-1 and 23-2 are arranged in accordance with the positioning of the wire connecting portions 72-1 and 72-2 as is shown in FIG. 10C.

The first and second signal wires 23-1 and 23-2 arranged in this manner are respectively connected to the wire connecting portions 72-1 and 72-2 through soldering, for example. Also, the drain wire 25 is connected to the wire connecting portion 83 through soldering, for example. It is noted that the shaded portions of FIG. 6 represent the solder used for the connection in the illustrated embodiment.

Since the wire connecting portions 72-1 and 72-2 are U-shaped, and the first and second signal wires 23-1 and 23-2 are arranged to be in a predetermined position, the signal wires 23-1 and 23-2 may be engaged to their corresponding wire connecting portions 72-1 and 72-2 before the soldering process is performed. Specifically, the signal wires 23-1 and 23-2 are restricted from moving in the X1-X2 directions and accommodated into the wire connecting portions 72-1 and 72-2. Thereby, the process of soldering the signal wires 23-1 and 23-2 to their respective signal contacts 70-1 and 70-2 may be facilitated.

The wire connecting portion 83 is also U-shaped, and the drain wire 25 may be engaged to the wire connecting portion 83 to be restricted from movement. Thereby, the soldering of the drain wire 25 to the ground contact 80 may be facilitated.

In the balanced transmission cable connector 50 as described above, the first and second signal contacts 70-1 and 70-2, the soldering portions of the signal wires 23-1 and 23-2 and the signal contacts 70-1 and 70-2, and the signal wires 23-1 and 23-2 make up the data transmission paths. In this embodiment, since the first and second signal contacts 70-1 and 70-2 are hidden within a projected region of the ground contact 80 when viewed from the X2 side in the X1 direction, and since the relay substrate 12 used in the conventional balanced transmission cable connector is not implemented, the shield between data transmission paths for adjacent signal pairs may be improved compared to the conventional art. Thereby, improved high speed signal transmission characteristics may be realized in the balanced transmission cable connector 50 so that a signal may be transmitted with higher speed compared to the conventional art. Also, a length L10 (FIG. 5) of the balanced transmission cable connector 50 in the Y1-Y2 directions may be shortened with respect to the conventional art.

In the following, a balanced transmission cable connector according to a second embodiment of the present invention is described. The balanced transmission cable connector according to the second embodiment differs from the first embodiment in that it does not implement a wire arranging member. Also, the balanced transmission cable connector of the second embodiment has a plug structure differing from that of the first embodiment. The plug structure of the second embodiment and related portions thereof are described below.

Figure 11:
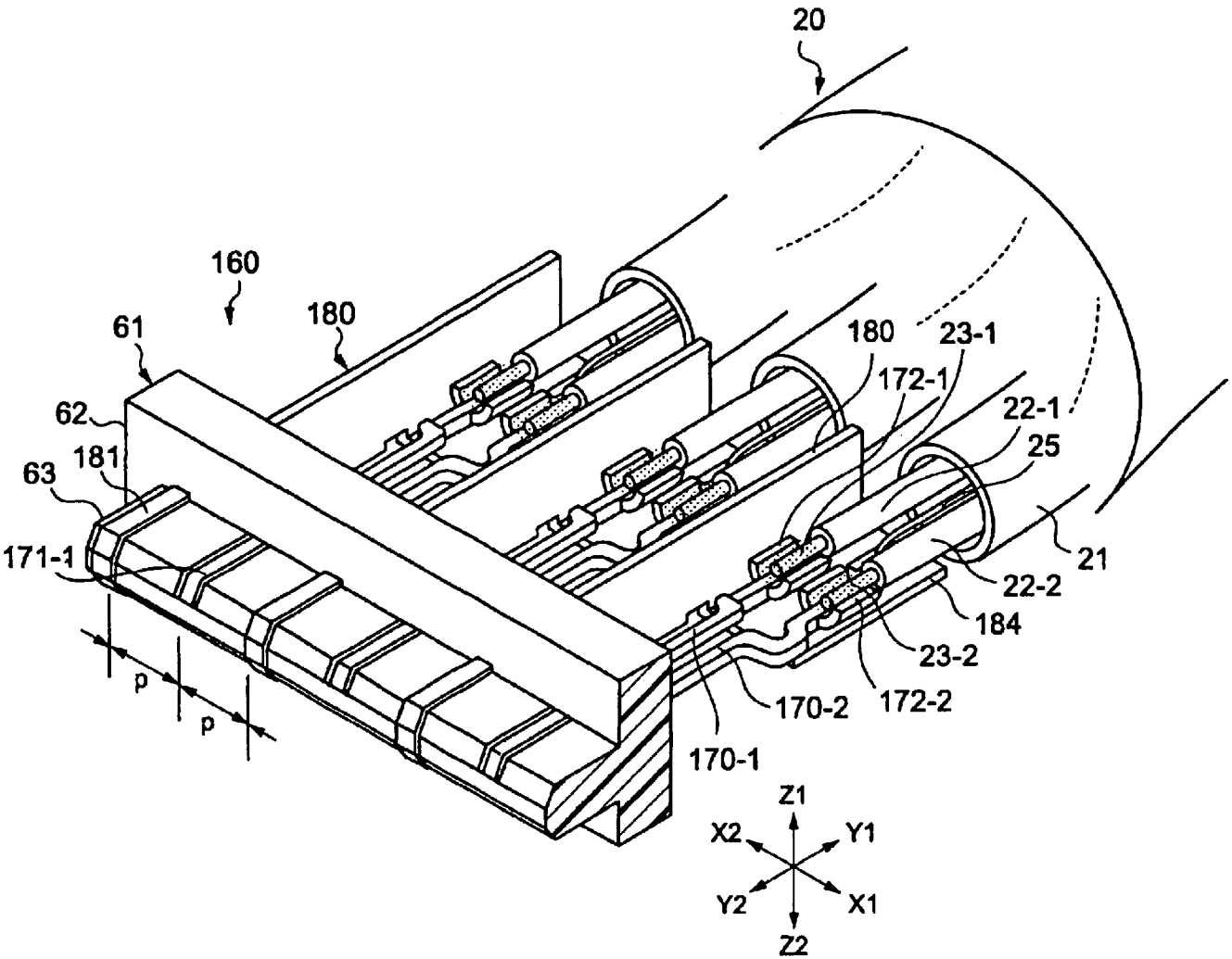
FIG. 11 shows an enlarged view of a connecting portion of a balanced transmission cable and a plug structure in a balanced transmission cable connector according to a second embodiment of the present invention.
Figure 12:
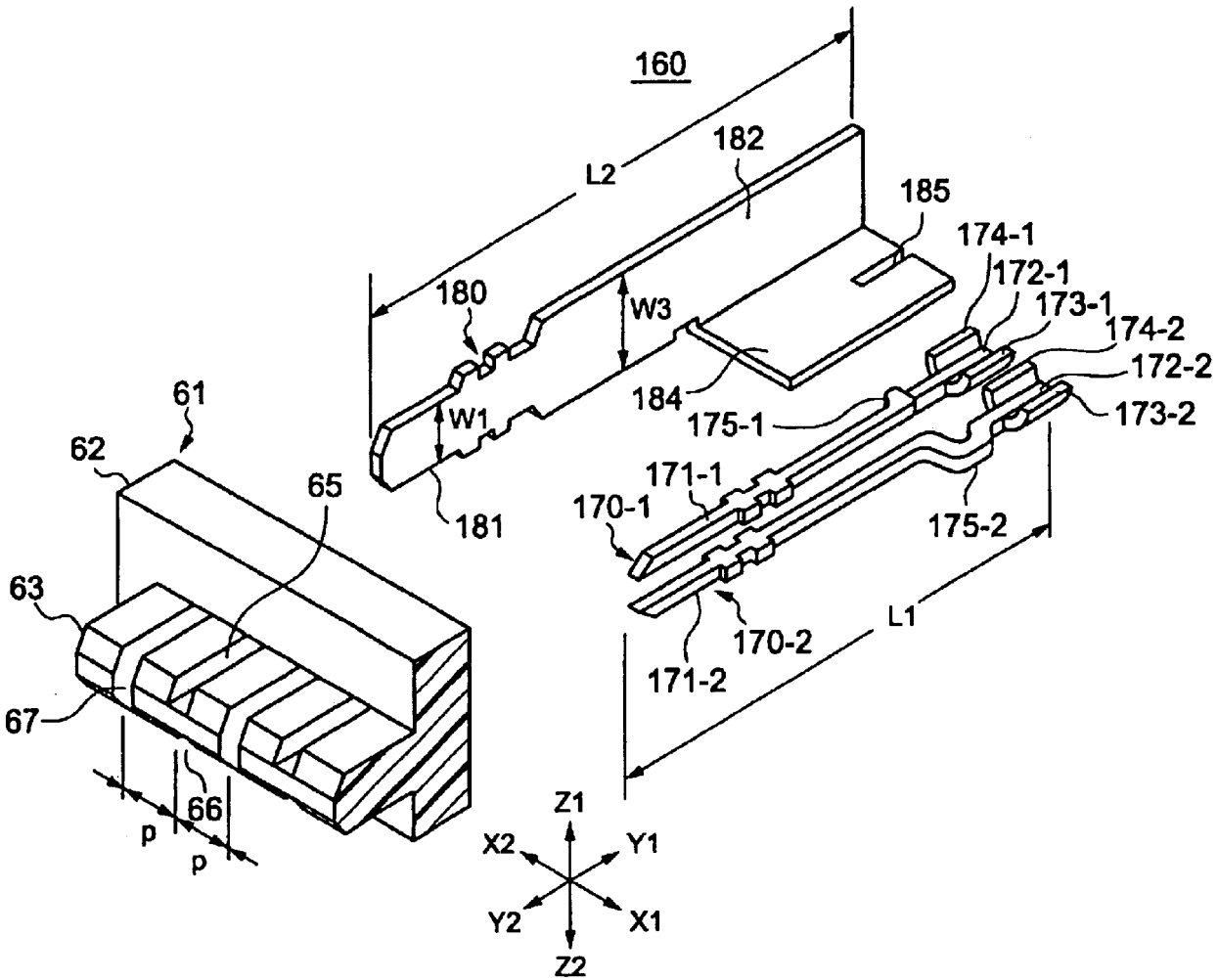
FIG. 12 shows a perspective view of the plug structure of FIG. 11 in a partially deconstructed state.
Figure 13:
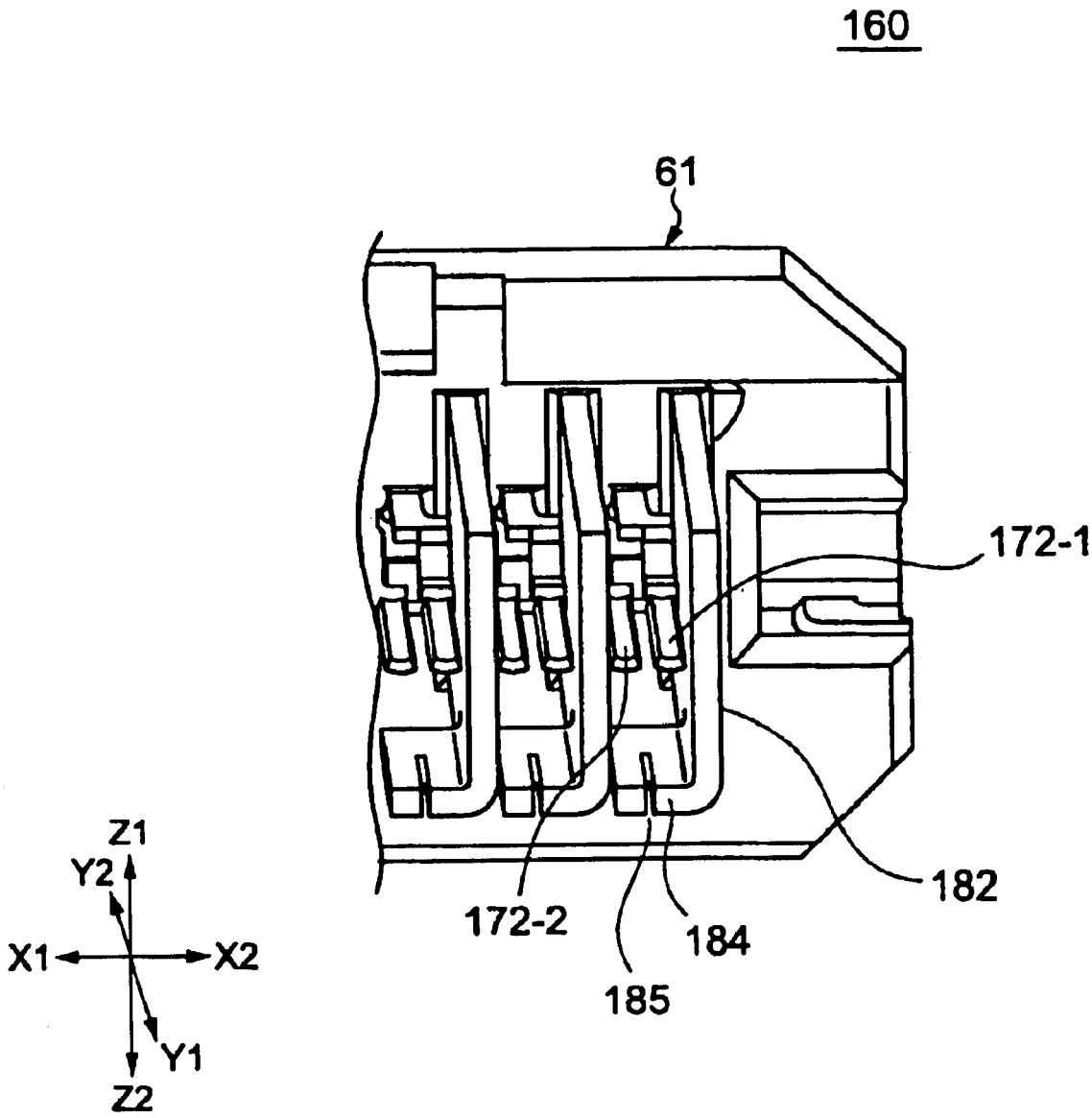
FIG. 13 shows a perspective view of the plug structure of FIG. 11 viewed from its back side.

FIGS. 11~13 are diagrams illustrating the plug structure 160 according to the second embodiment. It is noted that the components of the plug structure 160 that correspond to the components of the plug structure 60 of the first embodiment are represented by numerals that are sums of 100 and the corresponding numerical references in FIGS 6~9.

The plug structure 160 includes a block unit 61 corresponding to, for example, a synthetic resin molded article provided with electrical isolation. Pairs of first and second signal contacts 170-1 and 170-2, and sheet-shaped ground contacts 180 are press fit into the block unit 61 from the Y1 side to be alternatingly arranged in the X1-X2 direction at predetermined pitches p. In this configuration, the pairs of the first and second signal contacts 170-1 and 170-2 that are adjacent to each other with respect to the X1-X2 direction are shielded by the ground contact 180. Also, the first and second signal contacts 170-1 and 170-2, and the ground contacts 180 are electrically isolated by the block unit 61.

Referring to FIG. 12, the first signal contact 170-1 includes a rod-shaped contact main body 171-1 at the Y2 side, a hook portion 175-1 at the Y1 side, and a U-shaped signal wire connecting portion 172-1 at the Y1 side end of the hook portion 175-1. The signal wire connecting portion 172-1 has lug portions 173-1 and 174-1 that extend in the X1-X2 directions and bend in the Z1 direction.

The second signal contact 170-2 includes a rod-shaped contact main body 171-2 at the Y2 side, a hook portion 175-2 at the Y1 side, and a U-shaped signal wire connecting portion 172-2 at the Y1 side end of the hook portion 175-2. The signal wire connecting portion 172-2 includes lug portions 173-2 and 174-2 that extend in the X1-X2 directions and bend in the Z2 direction.

The ground contact 180 is formed into a sheet shape, and includes a Y2 side ground contact portion 181, a Y1 side ground contact portion 182, and a horizontally extending drain wire connecting portion 184 that is bent from the Y1 side bottom edge of the Y1 side ground contact portion 182 to extend horizontally in the X1 direction. At the Y1 side of the drain wire connecting portion 184, a slit 185 is formed into which the drain wire 25 is inserted (FIG. 11). The width W3 of the Y1 side ground contact portion 182 is greater than the width W1 of the Y2 side ground contact portion 181.

Also, given that the lengths of the first and second signal contacts 170-1 and 170-2 are denoted as L1, and the length of the ground contact 180 is denoted as L2, a relation L2>L1 is established.

The first and second signal contacts 170-1 and 170-2 are press fit into the trenches 65 and 66, respectively, and the Y2 side ground contact portion 181 of the ground contact 180 are press fit into the slit 67.

Figure 14A:
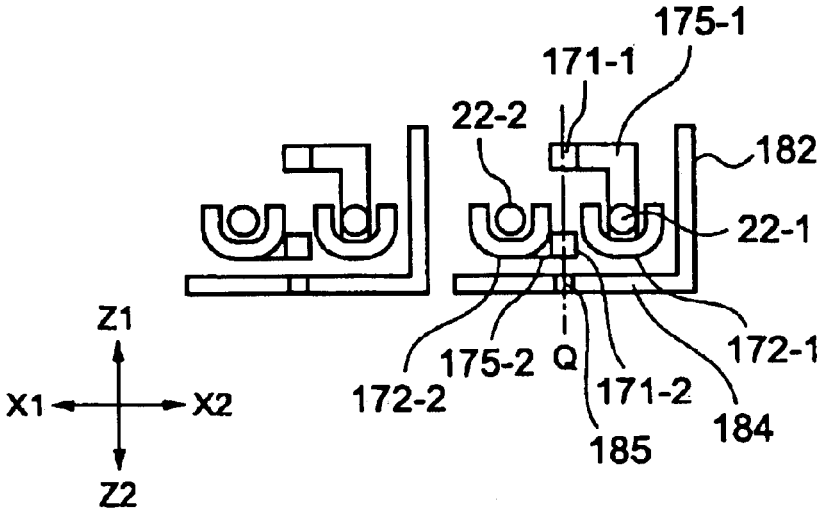
FIGS. 14A and 14B are diagrams illustrating an arrangement of signal contacts, a ground contact, signal wires, and a drain wire in the balanced transmission cable connector of FIG. 11

In the following, the positioning of the first and second signal contacts 170-1 and 170-2, and the ground contact 180 is described with reference to FIGS. 14A and 14B. FIG. 14A shows the positioning of the first and second signal contacts 170-1 and 170-2, and the ground contact 180 viewed from the Y1 side, and FIG. 14B shows the positioning of the first and second signal contacts 170-1 and 170-2, and the ground contact 180 viewed from the X1 side.

Figure 14B:
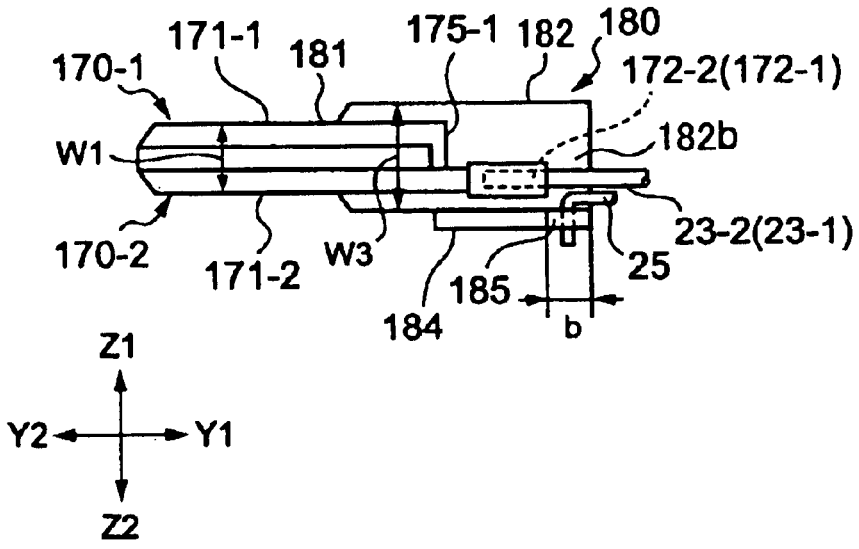

As is shown in FIG. 14B, the ground contact 180 extends in the Y1 direction beyond the Y1 side ends of the wire connecting portions 172-1 and 172-2 of the first and second signal contacts 170-1 and 170-2. A portion 182*b* corresponds to a portion of the ground contact 180 that extends in the Y1 direction beyond the Y1 side ends of the wire connecting portions 172-1 and 172-2. The first and second signal contacts 170-1 and 170-2 are hidden behind the projected region of the ground contact 180 when viewed from the X2 side in the X1 direction. The horizontally extending drain wire connecting portion 184 covers the Z2 side of the signal wire connecting portions 172-1 and 172-2. In this embodiment, adjacent pairs of first and second signal contacts 170-1 and 170-2 that are adjacent to each other with respect to the X1-X2 directions may be effectively shielded by the ground contact 180.

As is show in FIG. 14A, the wire connecting portions 172-1 and 172-2 are positioned at the same height as that of the contact main body 171-2, and the wire connecting portions 172-1 and 172-2 are positioned opposite to each other with respect to a position Q to which the contact main bodies 171-1 and 171-2 are aligned the contact. The slit 185 is arranged to be positioned in between the wire connecting portions 172-1 and 172-2 with respect to the X1-X2 directions at position Q, and further off in the Y1 direction from the Y1 side ends of the wire connecting portions 172-1 and 172-2 with respect to the Y1-Y2 directions as is shown in FIG. 14B.

The wires of the first and second signal wires 23-1 and 23-2 of the wire lines 21 of the balanced transmission cable 20 are connected to their respective wire connecting portions 172-1 and 172-2 through soldering, for example, and the drain wires 25 are connected to their corresponding drain wire connecting portions 184 through soldering, for example.

In the process of soldering the wires, plural wire lines 21 are aligned in the X1-X2 directions, and starting with a wire line 21 at a side end, the drain wire 25 is bent in the Z2 direction and inserted into the slit 185 from the Y1 side so that the wire line 21 may be prevented from moving freely. The first and second signal wires 23-1 and 23-2 are placed on the wire connecting portions 172-1 and 172-2, respectively. In this state, the first and second signal wires 23-1 and 23-2 are soldered to the wire connecting portions 172-1 and 172-2, respectively, and the drain wire 25 is soldered to the drain wire connecting portion 184. It is noted that the soldering is preferably performed from the Z1 side as opposed to both the Z1 side and the Z2 side for better workability.

By implementing the horizontally extending drain wire connecting portion 184, the balanced transmission cable connector of the present embodiment may be able to achieve an even better shielding effect between adjacent signal pairs in comparison to the balanced transmission cable connector 50 of the first embodiment.

Further, the present invention is not limited to these embodiments, and variations and modifications may be made without departing from the scope of the present invention.

The present application is based on and claims the benefit of the earlier filing date of Japanese Patent Application No. 2003-318517 filed on Sep. 10, 2003, the entire contents of which are hereby incorporated by reference.

What is claimed is:

1. A balanced transmission cable connector, comprising:

a balanced transmission cable that includes a drain wire and at least one wire pair of a first coated signal wire and a second coated signal wire, the first and second coated signal wires including respective first and second coatings and respective first and second signal wires extending from the respective first and second coatings; and a plug structure including a block unit, a ground contact, and first and second adjacent pairs, each pair of a first signal contact and a second signal contact, wherein the ground contact and the first and second pairs of the first signal contacts and the second signal contacts are aligned in an alignment direction with respect to one another and held by the block unit, and wherein the ground contact is disposed between the first and second adjacent pairs of the first signal contacts and the second signal contacts; wherein at least one of the first signal contacts includes a first signal wire connecting portion to which the first signal wire is connected, and at least one of the second signal contacts includes a second signal wire connecting portion to which the second signal wire is connected; and the ground contact includes a drain wire connecting portion to which the drain wire is connected and further comprising a lug portion which is bent to engage the drain wire, and which restricts movement of the drain wire from the alignment direction thereof.

2. The balanced transmission cable connector as claimed in claim 1, wherein the ground contact is arranged to be longer than said at least one first signal contact and said at least one second signal contact.

3. The balanced transmission cable connector as claimed in claim 1, wherein at least one of the first signal wire connecting portion and the second signal wire connecting portion has a lug portion that is bent into a shape that restricts movement from the alignment direction of the respective first and second signal wire to which it is connected.

4. The balanced transmission cable connector as claimed in claim 1, wherein said at least one wire pair of a first coated signal wire and a second coated signal wire includes first and second adjacent wire pairs, each pair of a first coated signal wire and a second coated signal wire;

and further comprising a wire arranging member including an inter wire pair arranging portion that arranges a positioning between the first and second adjacent wire pairs, each pair of a first coated signal wire and a second coated signal wire, and a wire pair internal arranging portion that arranges a positioning of the first coated signal wire and the second coated signal wire, of at least one of the first and second adjacent wire pairs.

5. The balanced transmission cable connector as claimed in claim 1, wherein the block unit is of a material affording electrical isolation.

6. The balanced transmission cable connector as claimed in claim 5, wherein the block unit material is a synthetic resin.

7. A balanced transmission cable connector, comprising:

a balanced transmission cable that includes a drain wire and at least one wire pair of a first coated signal wire and a second coated signal wire, the first and second coated signal wires including respective first and second coatings and respective first and second signal wires extending from the respective first and second coatings; and a plug structure including a block unit, a ground contact, and first and second adjacent pairs of a first signal contact and a second signal contact, wherein the ground contact and the first and second pairs of the first signal contact and the second signal contact are aligned in an alignment direction with respect to one another and held by the block unit, and wherein the ground contact is disposed between the first and second adjacent pairs of the first signal contact and the second signal contact; wherein at least one of the first signal contacts includes a first signal wire connecting portion to which the first signal wire is connected, and at least one of the second signal contacts includes a second signal wire connecting portion to which the second signal wire is connected;

the ground contact includes a drain wire connecting portion to which the drain wire is connected;

the first signal wire connecting portion and the second signal wire connecting portion are aligned in the same direction as the alignment direction;

the drain wire connecting portion extends horizontally to cover bottom sections of the first signal wire connecting portion and the second signal wire connecting portion; and the drain wire connecting portion includes a slit into which the drain wire is inserted.

8. The balanced transmission cable connector as claimed in claim 7, wherein the ground contact is arranged to be longer than said at least one first signal contact and said at least one second signal contact.

9. The balanced transmission cable connector as claimed in claim 7, wherein at least one of the first signal wire connecting portion and the second signal wire connecting portion has a lug portion that is bent into a shape that, restricts movement from the alignment direction of the respective first and second signal wire to which it is connected.

10. The balanced transmission cable connector as claimed in claim 7, wherein said at least one wire pair of a first coated signal wire and a second coated signal wire includes a first and second adjacent wire pairs of a first coated signal wire and a second coated signal wire;

and further comprising a wire arranging member including an inter wire pair arranging portion that arranges a positioning between the first and second adjacent wire pairs of a first coated signal wire and a second coated signal wire, and a wire pair internal arranging portion that arranges a positioning of the first coated signal wire and the second coated signal wire of at least one of the first and second adjacent wire pairs.

11. The balanced transmission cable connector as claimed in claim 7, wherein the block unit is of a material affording electrical isolation.

12. The balanced transmission cable connector as claimed in claim 11, wherein the block unit material is a synthetic resin.

13. A plug structure for use with a balanced transmission cable, which balanced transmission cable includes a drain wire and at least one wire pair of a first coated signal wire and a second coated signal wire, the first and second coated signal wires including respective first and second coatings and respective first and second signal wires extending from the respective first and second coatings; the plug structure comprising:

a block unit;

a ground contact;

first and second adjacent pairs, each pair of a first signal contact and a second signal contact, the ground contact and the first and second pairs of the first signal contact and the second signal contact being aligned in an alignment direction with respect to one another and held by the block unit, and the ground contact being disposed between the first and second adjacent pairs of the first signal contact and the second signal contact;

at least one of the first signal contacts includes a first signal wire connecting portion to which the first signal wire is connectable, and at least one of the second signal contacts includes a second signal wire connecting portion to which the second signal wire is connectable; and the ground contact including a drain wire connecting portion to which the drain wire is connectable, further comprising a lug portion which is bent to engage the drain wire, the drain wire connecting portion restricting movement of the drain wire, when connected thereto, from the alignment direction thereof.

14. The plug structure as claimed in claim 13, wherein the ground contact is longer than said at least one first signal contact and than said at least one second signal contact.

15. The plug structure as claimed in claim 13, wherein at least one of the first signal wire connecting portion and the second signal wire connecting portion has a lug portion that is bent into a shape that, when connected to the respective first and second signal wire, is operative to restrict movement of the respective first end second signal wire from the alignment direction.

16. The plug structure as claimed in claim 13, wherein the block unit is of a material affording electrical isolation.

17. The balanced transmission cable connector is claimed in claim 16, wherein the block unit material is a synthetic resin.

18. The plug structure as claimed in claim 13, wherein the block unit is of a material affording electrical isolation.

19. The balanced transmission cable connector as claimed 18, wherein the block unit material is a synthetic resin.

20. A plug structure for use with a balanced transmission cable, which balanced transmission cable includes a drain wire and at least one wire pair of first coated signal wire and a second coated signal wire, the first and second coated signal wires including respective first and second coatings and respective first and second signal wires extending from the respective first and second coatings, the plug structure comprising:

a block unit;

a ground contact;

first and second adjacent pairs, each pair of a first signal contact and a second signal contact, wherein the ground contact and the first end second pairs of the first signal contact and the second signal contact being aligned in an alignment direction with respect to one another and held by the block unit, and the ground contact being disposed between the first and second adjacent pairs of the first signal contact and the second signal contact;

at least one of the first signal contacts including a first signal wire connecting portion to which the first signal wire is connectable, and at least one of the second signal contacts including a second signal wire connecting portion to which the second signal wire is connectable;

the ground contact Including a drain wire connecting portion to which the drain wire is connectable;

the first signal wire connecting portion and the second signal wire connecting portion being aligned in the same direction as the alignment direction; and the drain wire connecting portion extending horizontally to cover bottom sections of the first signal wire connecting portion and the second signal wire connecting portion and having a slit into which the drain wire is insertable.

21. The plug structure as claimed in claim 20, wherein the ground contact is longer than said at least one first signal contact and than said at least one second signal contact.

22. The plug structure as claimed in claim 20, wherein the block unit is of a material affording electrical isolation.

23. The plug structure as claimed in claim 20, wherein at least one of the first signal wire connecting portion and the second signal wire connecting portion has a lug portion that is bendable to engage the respective one of the first and second signal wires and restrict movement thereof from the alignment direction.

24. The plug structure as claimed in claim 23, wherein the block unit material is a synthetic resin.

* * * * *

UNITED STATES PATENT AND TRADEMARK OFFICE

CERTIFICATE OF CORRECTION

PATENT NO. : 6,923,682 B2
APPLICATION NO. : 10/832349
DATED : August 2, 2005
INVENTOR(S) : Junichi Akama et al.

It is certified that error appears in the above-identified patent and that said Letters Patent is hereby corrected as shown below:

Column 10, Line 31, delete “that,” and insert - - that - - therefor.
Column 11, Line 26, delete “end” and insert - - and - - therefor.
Column 11, line 40, after “pair of” insert - - a - -.
Column 12, Line 5, delete “end” and insert - - and - - therefor.
Column 12, Line 17, delete “Including” and insert - - including - - therefor.

Signed and Sealed this

Twenty-second Day of August, 2006

JON W. DUDAS
*Director of the United States Patent and Trademark Office*